US007111402B1

(12) United States Patent
Pearman

(10) Patent No.: US 7,111,402 B1
(45) Date of Patent: Sep. 26, 2006

(54) HAND TOOL

(75) Inventor: Robert E. Pearman, Gray, TN (US)

(73) Assignee: Taylor Brands LLC, Kingsport, TN (US)

( * ) Notice: Subject to any disclaimer, the term of this patent is extended or adjusted under 35 U.S.C. 154(b) by 7 days.

(21) Appl. No.: 11/075,722

(22) Filed: Mar. 10, 2005

(51) Int. Cl.
*B26B 1/04* (2006.01)
*B26B 1/02* (2006.01)

(52) U.S. Cl. ..... 30/158; 30/151; 30/155; 7/901

(58) Field of Classification Search ..... 30/155, 30/158; 7/901; 16/320
See application file for complete search history.

(56) References Cited

U.S. PATENT DOCUMENTS 5,815,866 A * 10/1998 Janky ..... 7/114
6,308,420 B1 * 10/2001 Moser ..... 30/158
2005/0132576 A1 * 6/2005 Onion ..... 30/158

* cited by examiner

*Primary Examiner*—Lowell A. Larson
(74) *Attorney, Agent, or Firm*—Stevens, Davis, Miller & Mosher, LLP

(57) ABSTRACT

A tool generally consisting of a handle, an implement pivotally connected to the handle, a first magnetic element mounted on the implement having a magnetic field of a selected polarity intersecting a path disposed circumferentially relative to the axis of the pivotal connection and a second magnetic element mounted on the handle having a magnetic field of a polarity of one of the same or the opposite of the selected polarity intersecting the circumferential path whereby dependent upon the angular relationship of the handle and the implement, the magnetic fields will have the effect of one of a first interaction, producing no motive force for angularly biasing the implement relative to the handle, a second interaction producing a repellant motive force for angularly biasing the implement relative to the handle and a third reaction producing an attractive motive force for angularly biasing the implement relative to the handle.

64 Claims, 4 Drawing Sheets

HAND TOOL

This invention relates to a hand tool provided with a handle and an implement pivotally connected to such handle in which the implement may be angularly displaced relative to the handle manually into retracted and extended positions, and more particularly to such a tool having means for providing a motive force cooperable with a manual force applied for angularly displacing the implement relative to the handle between its retracted and extended positions.

BACKGROUND OF THE INVENTION

In the prior art, there is a myriad of hand tools generally consisting of a handle and an implement pivotally connected to such a handle, which may be angularly displaced relative to the handle between fully retracted and fully extended positions. Typically, when the implement of such a tool is in the fully retracted position relative to the handle, usually partially received within a recess in the handle, such handle may be gripped with one hand and the implement may be displaced from the fully retracted position to the fully extended position either by manipulation of the fingers on the hand holding the handle or by the fingers of the other hand of the user. Generally, it is preferred that such tools be capable of being held by a hand and manipulated with the fingers of such hand in displacing the implement between the retracted and extended positions. Often, however, because of the design of such tools, the fingers of the hand holding the handle of the tool are unable to bring sufficient force to bear on the implement of the tool to easily and conveniently displace the tool between the fully retracted and fully extended positions of the implement. To assist the manual force applied by the fingers of a hand holding such a tool, in either angularly displacing the implement relative to the handle from a retracted to an extended position or an extended position to the retracted position, prior art tools of such type typically have provided various biasing devices such as coil springs and leaf springs which function to provide a motive force tending to angularly bias the implement. Such mechanisms, however, because of their size and intricacy often provide complicated and expensive manufacturing operations.

In view of the perceived inadequacies of such mechanisms in prior art hand tools of the type described, it has been found to be desirable to provide such a hand tool which may be gripped with a hand, manipulated by the fingers of the hand gripping the tool to angularly displace the implement of the tool relative to the handle and provide a means to produce a motive force cooperating with such manual force for angularly displacing the implement relative to the handle of such tools.

SUMMARY OF THE INVENTION

The present invention provides a novel tool which generally consists of a handle, an implement pivotally connected to the handle, a first magnetic element mounted on the implement providing a magnetic field of selected polarity intersecting a path disposed circumferentially relative to the axis of the pivotal connection of the implement to the handle, and a second magnetic element mounted on the handle having a magnetic field of a polarity of the same or opposite of the selected polarity intersecting the circumferential path. Dependent upon the angular relationship of the implement relative to the handle, the magnetic fields will have the effect of a first interaction, producing no motive force for biasing an angular displacement of the implement relative to the handle, a second interaction producing a repellant motive force for biasing an angular displacement of the implement relative to the handle and a third interaction producing an attractive motive force for biasing an angular displacement of the implement relative to the handle. Preferably, a pair of such sets of magnetic elements are provided angularly or circumferentially spaced apart to provide various interactions of the magnetic fields thereof to cause angular displacement of the implement relative to the handle.

DETAILED DESCRIPTION OF THE EMBODIMENTS OF THE INVENTION

Figure 1:
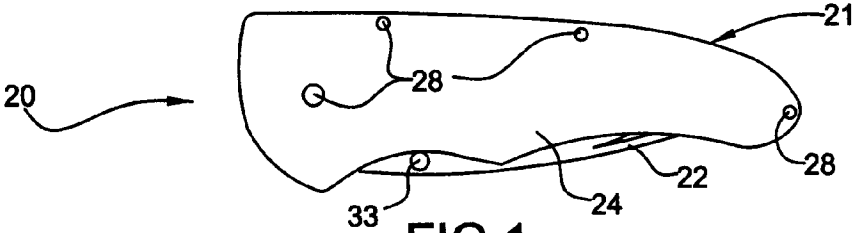
FIG. 1 is a side elevational view of a pocket knife embodying the present invention.
Figure 2:
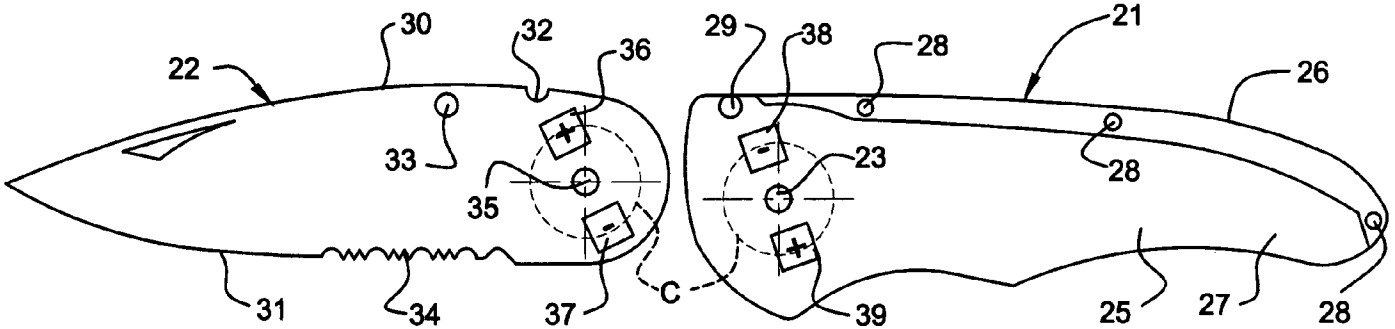
FIG. 2 is a side elevational view of the embodiment shown in FIG. 1, illustrating a handle component thereof having a side wall removed, and a blade component thereof disconnected from such handle.

Referring to FIGS. 1 through 6 of the drawings, there is illustrated an embodiment of the invention consisting of a pocket knife 20. The knife includes a handle 21 and a blade 22 pivotally connected to the handle by means of a pin 23. Handle 21 has an elongated configuration so that it may be gripped by a hand of a user and includes a pair of side walls 24 and 25 spaced by a spine member 26 disposed along the upper edges of the side wall members to provide an elongated, narrow recess 27. The side walls and interposed spine member are secured together by means of a set of rivets 28.

The spine member extends from a point rearwardly of the front edges of the side wall members to permit the insertion of the end portion of blade 22 for pivotal connection to pin 23, and extends to the rearward ends of the side wall members. Connected to the side wall members forward of the front end of the spine member is a stop pin 29. Generally, the handle may be configured in any manner to accommodate the grip of a hand of the user, and may be formed of any magnetically inert material such as a plastic, a ceramic or aluminum. As used herein, the term magnetically inert material is considered to be a material which behaves no differently from a vacuum in the presence of a magnetic field.

Figure 3:
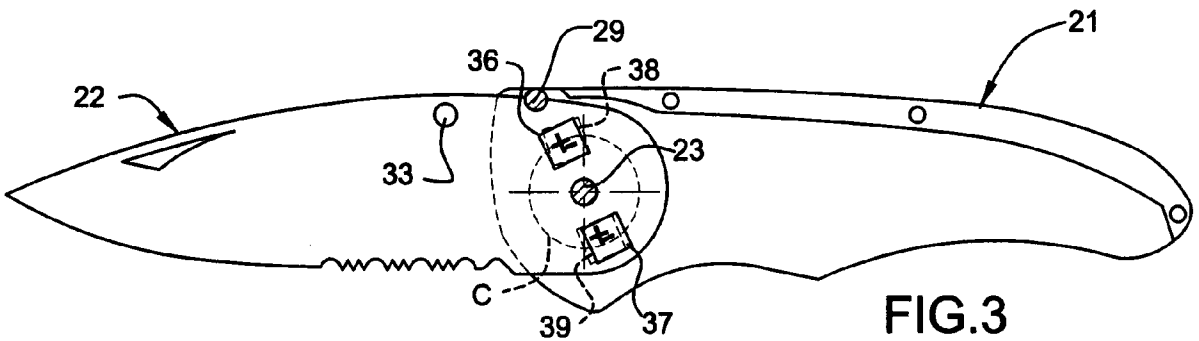
FIG. 3 is a view similar to the view shown in FIG. 2, illustrating the blade component pivotally connected to the handle component, and disposed in a fully extended position.
Figure 6:
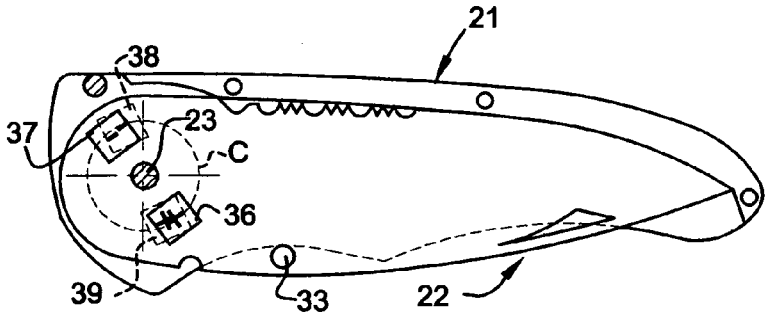
FIG. 6 is a view similar to the view shown in FIG. 5, illustrating a further sequential position of the blade component, fully retracted with respect to the handle component.
Figure 7:
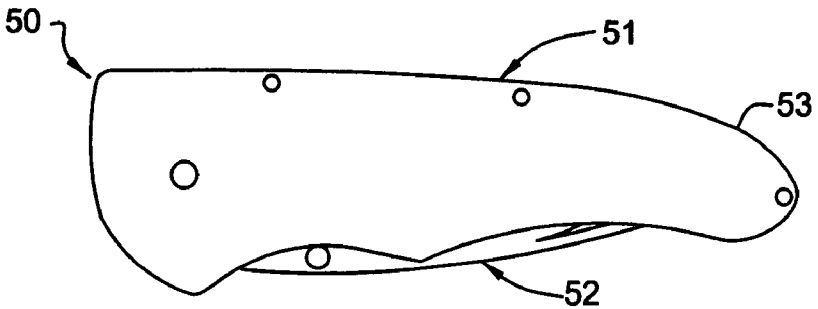
FIG. 7 is a side elevational view of another embodiment of the invention.

Blade 22 is of a conventional configuration including an upper edge 30 and a lower edge 31 converging to a forward pointed end. The upper edge is provided with a notch 32 and stop pin 33 is provided adjacent the upper edge, forward of notch 32. Bottom edge 31 constitutes a cutting edge which is provided with a serrated portion 34. Provided at the rearward end thereof is an opening 35 adapted to receive pivot pin 23 for pivotally connecting the rear end of the blade to the forward end of handle 21 between side walls 24 and 25 of the handle. When pivotally connected to the forward end of the handle by means of pivot pin 23, the blade may be angularly displaced relative to the handle in a fully extended position as shown in FIG. 3 and angularly displaced approximately 180° to a fully retracted position within recess 27 as shown in FIG. 6. When the blade is in the fully extended position, stop pin 29 on the handle is received in notch 32 of the blade to arrest the angular displacement of the blade relative to the handle in a clockwise direction as shown in FIG. 3. When the blade is angularly displaced in a counter-clockwise direction from the position shown in FIG. 3 to the retracted position as shown in FIG. 6, stop pin 33 will engage the lower edges of handle side walls 24 and 25 to arrest the motion of the blade in such direction. As best seen in FIG. 6, when the blade is in the fully retracted position within recess 27 of the handle, a portion thereof will extend beyond the lower edges of side walls 24 and 25 to permit the blade to be engaged by the fingers of the user in pivoting the blade from the fully retracted position as shown in FIG. 6 to the fully extended position as shown in FIG. 3. Blade 22 also is formed of a magnetically inert material such as stainless steel.

Mounted on or embedded in the rear end of blade 22 which is inserted in the forward end of handle 21 and pivotally connected thereto by means of pivot pin 23, is a set of diametrically opposed permanent magnets 36 and 37. When blade 22 is connected to handle 21 as shown in FIG. 3 and angularly displaced relative to the handle, the magnetic fields produced by permanent magnets 36 and 37 will circumscribe and intersect a circumferential path C. Such magnets are arranged so that magnet 36 produces a magnetic field of a positive polarity intersecting circumferential path 38, and magnet 37 produces a magnetic field of a negative polarity intersecting the circumferential path. Similarly mounted on or embedded in at least one of the side walls of the handle is a pair of diametrically spaced permanent magnets 38 and 39 also producing magnetic fields intersecting circumferential path 38. In the embodiment as shown, permanent magnet 38 would produce a field of negative polarity and permanent magnet 39 would produce a field of positive polarity. As will be appreciated, when blade 22 is pivotally connected to handle 21 and angularly displaced relative to the handle about the axis of connecting pin 23, the interactions of the magnetic fields of permanent magnets 36 and 38 with the magnetic fields of permanent magnets 38 and 39 will cause the blade to be biased angularly relative to the handle depending upon the angular displacement of the permanent magnets and their respective fields and the polarity or polarities of interacting magnetic fields.

In the embodiment shown in FIGS. 1 through 6, when the blade is in the fully retracted position within the recess of the handle as shown in FIG. 6, magnets 37 and 38 will at least partially overlap so that the magnetic fields thereof, both of the same or negative polarity will interact to produce a resultant force vector causing the blade to be angularly biased in a counter-clockwise direction relative to FIG. 6 thus urging the blade into the fully retracted position as shown, with stop pin 33 engaging the lower edge of at least one of the side walls of the handle. Similarly, permanent magnets 36 and 39 will overlap so that their respective fields, both of a positive polarity, will interact to produce a motive force vector angularly biasing the blade in the retracted position. Preferably, when the blade is in the fully retracted position as shown in FIG. 6, magnet 37 will be displaced from magnet 38 and magnet 39 will be displaced from magnet 36, an angle in the range of 1° to 5° which would have the effect of enhancing the force imposed on the blade in the counter-clockwise direction for retaining the blade in the fully retracted within the recess.

Figure 4:
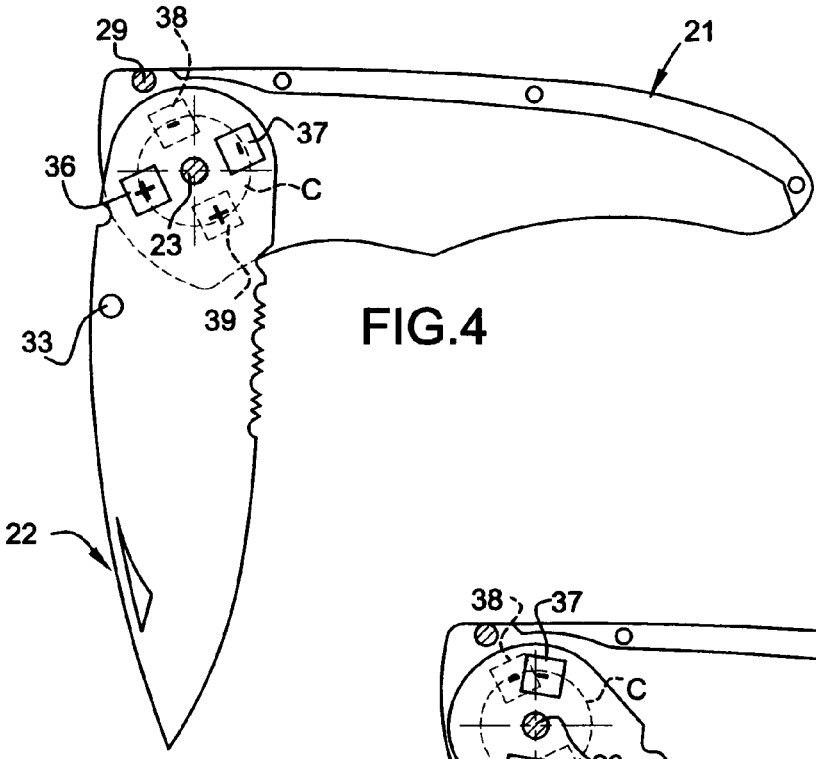
FIG. 4 is a view similar to the view shown in FIG. 3, illustrating the blade component in a sequential position as it is angularly displaced from the position shown in FIG. 3 toward a retracted position.
Figure 5:
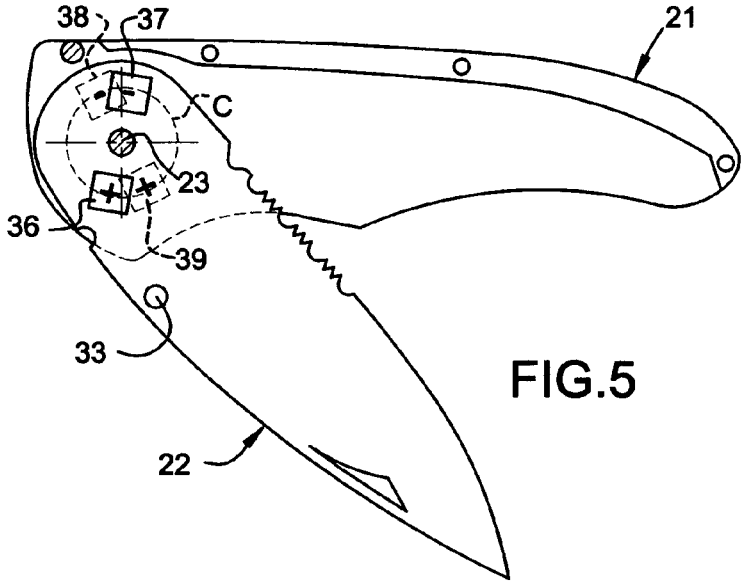
FIG. 5 is a view similar to the view shown in FIG. 4, illustrating a further sequential position as the blade component is angularly displaced from the position shown in FIG. 4 toward a fully retracted position.

As the blade is manually pivoted out of the recess in the clockwise direction as shown in FIG. 5, the repellant force produced by the interaction of the fields of magnets 37 and 38 of the same polarity and the repellant forces produced by the interaction of the fields of magnets 36 and 39 of the same polarity will cause the blade to be angularly biased in the clockwise direction to a position as shown in FIG. 4, whereupon the attractive force produced by the interaction of the fields of magnets 37 and 39 of opposed polarity and the attractive force produced by the interaction of the fields of magnets 36 and 38 will cause the blade to be continuously angularly biased in a clockwise direction until the blade engages stop pin 29 to position the blade in the extended position as shown in FIG. 3. With the interaction of the fields of magnets 37 and 39, of opposite polarities, and the interaction of the fields of magnets 36 and 38, of different polarities, providing attractive forces, the blade will be biasingly retained in the fully extended position.

To then reposition the blade from the fully extended position to the fully retracted position within the recess of the handle, the procedure as described essentially is reversed. With the handle being held in one hand either a finger of the hand holding the handle or the other hand would manually begin to pivot the blade in a counter-clockwise direction toward the position as shown in FIG. 4. In such position, the attractive force produced by the interaction of the fields of magnets 36 and 38 and the attractive force produced by the interaction of the fields of magnets 37 and 39 would be discontinued to permit the blade to be manually pivoted to the position as shown in FIG. 5 and then in the position as shown in FIG. 6. When the blade is returned to the recess of the handle as shown in FIG. 6, the repellant forces produced by the interaction of the fields of magnets 37 and 38 and the interaction of the fields of magnets 36 and 39 will cause the blade to be biasingly retained in the fully retracted position.

The manipulation of the blade of the knife described to pivot it between the fully retracted and the fully extended positions is accomplished by a combination of manually exerted forces and magnetic forces. The magnetic forces essentially augment the manually applied forces. To accommodate the application of manual forces, stop pin 33 is made long enough to project beyond handle side wall 24 so that the thumb of the hand holding the handle of the knife may be used to engage it and begin to pivot the blade out of the recess of the handle against the biasing forces of the cooperating magnets tending to biasingly retain the blade within the recess of the handle. The function of the manual force applied by the thumb essentially is to overcome magnetic forces tending to pivot the blade in the counter-clockwise direction. The displacement of the blade between the fully retracted and fully extended positions, however, can be accomplished with either a single hand or both hands of the user.

Within the scope of the invention, it is contemplated that a single set of magnets with interacting fields, two sets of magnets with interacting fields as described in connection with FIGS. 1 through 6 and more than two sets of magnets with interacting magnetic fields can be used to provide motive forces assisting in pivoting the blade in clockwise and counter-clockwise directions between the fully retracted and fully extended positions. The essential feature is the positioning of the magnets so that the interaction of their magnetic fields will provide either repellant or attractive forces or combinations thereof to bias an angular displacement of the blade relative to the handle. In addition, various angular displacements of the magnets on the handle and the blade with their fields intersecting one or more circumferential paths may be employed, and perhaps combinations involving magnets with fields of the same polarity being provided on one of the components of the knife. In perhaps the most basic arrangement, magnetic means would be provided for simply biasingly retaining the blade in the fully retracted and/or fully extended positions.

Figure 8:
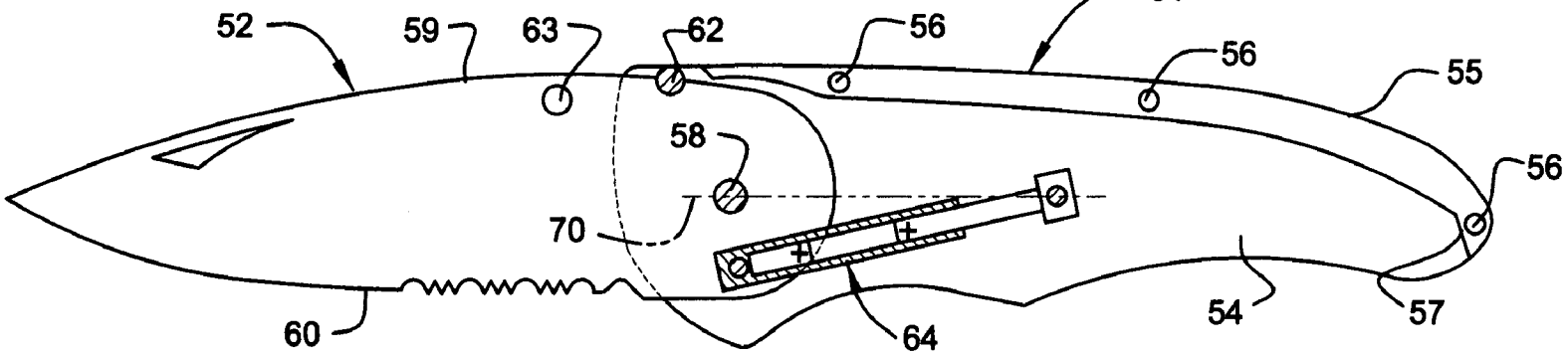
FIG. 8 is a side elevational view of the embodiment shown in FIG. 7, having a side wall of the handle component thereof removed and the blade component thereof disposed in a fully extended position relative to the handle component.
Figure 9:
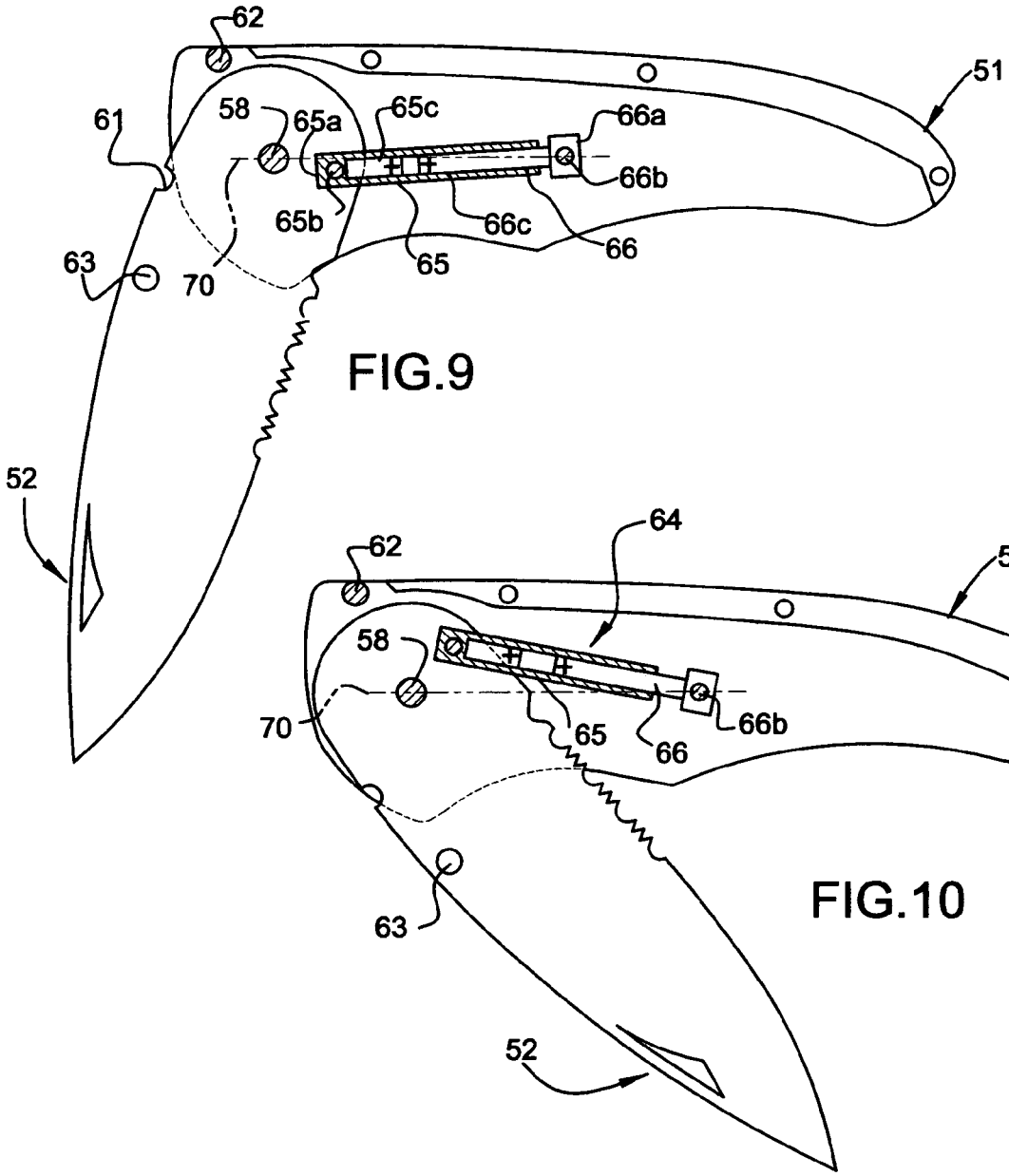
FIG. 9 is a view similar to the view shown in FIG. 8, illustrating the blade component thereof in a sequential position in being angularly displaced from the position as shown in FIG. 8 toward a fully retracted position.
Figure 10:
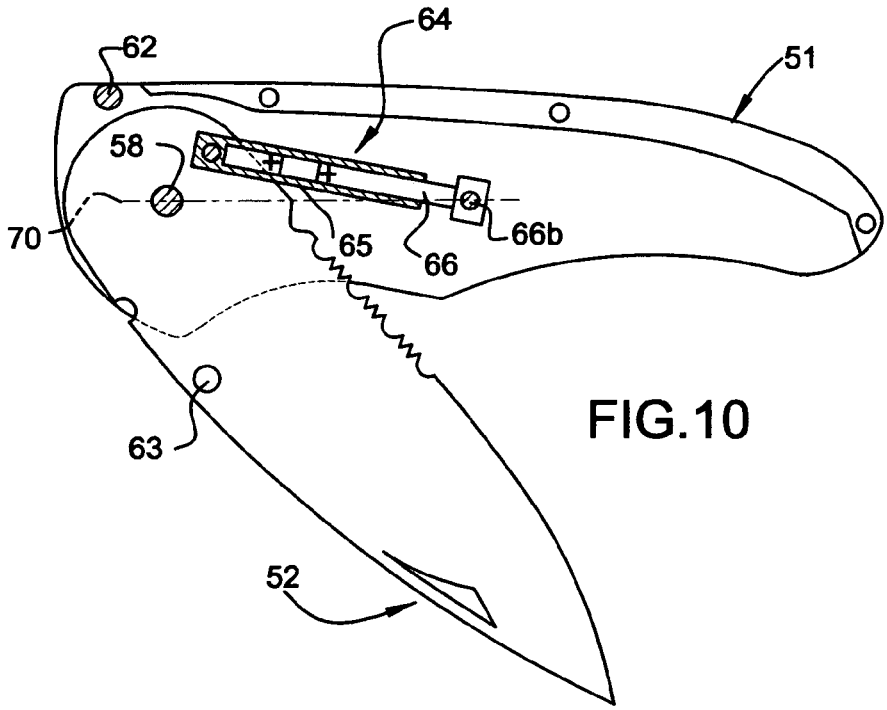
FIG. 10 is a view similar to the view shown in FIG. 9, illustrating a sequential position of the blade component in being angularly displaced from the position as shown in FIG. 9 to a fully retracted position.
Figure 11:
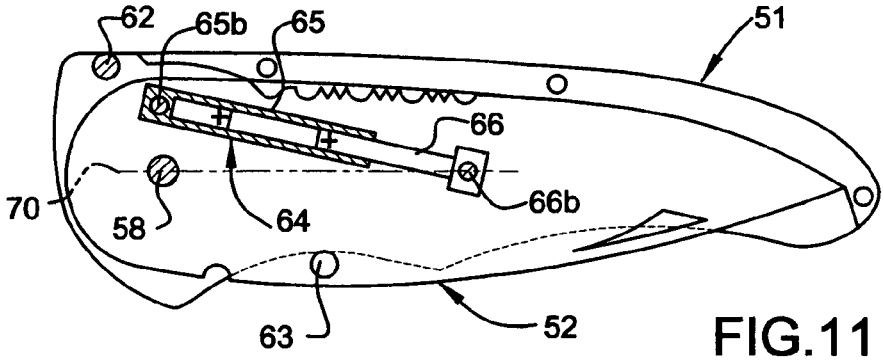
FIG. 11 is a view similar to the view shown in FIG. 10, illustrating the blade component thereof in a fully retracted position relative to the handle component.

Referring to FIGS. 7 through 11 of the drawings, there is illustrated another embodiment of the invention. Such embodiment consists of a knife 50 generally consisting of a handle 51 and a blade 52 pivotally connected to the handle for angular displacement between a fully retracted position as shown in FIG. 11 and a fully extended position as shown in FIG. 8. Handle 51 is similar to handle 21, including a pair of spaced side walls 53 and 54 and a spine member 55 interposed between the side walls and secured together by means of several spaced rivets 56, forming an elongated, thin recess 57. Provided at a forward end of the side walls is a pivot pin 58. Blade 52 is similar to blade 22, being pivotally connected to pivot pin 58 and having upper and lower edges 59 and 60 converging forwardly to a point. The upper edge of the blade is provided with a notch 61 which is adapted to receive a stop pin 62 provided on the forward end of the handle to arrest the angular displacement of the blade and thus position it in a fully extended position. Forwardly of such notch, the blade is provided with a stop pin 63 which is adapted to engage an edge of a handle side wall when the blade is angularly displaced within recess 57 in a fully retracted position. Stop pin 63 further may be provided with a sufficient length to enable a user of the knife grasping the handle portion thereof to engage such pin with the thumb of his hand to manually, angularly displace the blade out of the fully retracted position toward the fully extended position.

When a manual force is applied to either extend or retract the blade, such action may be complimented or supplemented by means of an actuating device 64. Such device consists of a tubular member 65 and a rod member 66 telescopically connected together. Tubular member 65 is provided with an end wall 65*a* pivotally connected to a rear end portion of blade 52, displaced radially relative to the axis of pivot pin 58. Rod member 66 is provided with an end portion 66*a* pivotally connected to a pin 66*b* disposed transversely between and connected to the side walls of the handle. Tubular member 65 is formed of a magnetically inert material such as a plastic, ceramic or aluminum and further is provided with a permanent magnet 65*c* disposed at an inner end thereof. Rod member 66 also is formed of a magnetically inert material and is provided with a permanent magnet 66*c* disposed on the end thereof in opposed relation to magnet 65*c*. Magnetic elements 65*c* and 66*c* are oriented in a manner whereby the confronting ends thereof are of the same polarity, either positive or negative, so that the fields thereof will interact to bias the tubular and rod members apart. The point of connection of pin 65*b* to the rear end of the blade is selected so that when the blade is in the fully retracted position as shown in FIG. 11, the axis of connecting pin of 65*b* will be disposed on one side of a rectilinear line 70 intersecting the axis of pins 58 and 66*b*, and when the blade is in the fully extended position as shown in FIG. 8, the axis of connecting pin 65*b* will be disposed on the other side of intersecting line 70. Because of the repellant force produced by the interaction of the magnetic field of magnetic elements 65*c* and 66*c*, when the blade is in the fully retracted position with the axis of pin 65*b* on the one side of intersecting line 70, the repelling action of the interacting magnetic fields will produce a force biasing the blade in a counter-clockwise direction to biasingly retain the blade in fully retracted position, and when the blade is in the fully extended position and the axis of pin 65*b* is on the other side of intersecting line 70, the repellant force produced by the interacting magnetic fields will bias the blade in a clockwise direction, biasingly retaining the blade in the fully extended position.

In the use of knife 51, with the blade in the fully retracted position within recess 57 as shown in FIG. 11, the knife may be grasped in the hand of a user and the thumb of the user may engage pin 65 to manually, angularly displace the blade in a clockwise direction toward the extended the position. As such manual force is applied, with the axis of pin 65*b* being disposed on the one side of intersecting line 70, the repellant magnetic force of device 64 will function to oppose the manual force being applied until the blade is angularly displaced at a point on the other side of intersecting line 70 as shown in FIG. 9 whereupon the force applied by device 64 will then compliment or supplement the manual force being applied to further angularly displace the blade from the position as shown in FIG. 9 to the fully extended position as shown in FIG. 8. With the blade in the fully extended position, device 64 will function to bias the blade in the fully extended position. When it is desired to angularly displace the blade from the fully extended position as shown in FIG. 8 through the sequential positions shown in FIGS. 9 and 10 to the fully retracted position as shown in FIG. 11, the handle would be grasped in one hand and the blade would be angularly displaced toward the handle against the biasing action of the actuating device until the axis of pin 65*b* advances to the other side of intersecting line 70 as shown in FIG. 10 whereupon the biasing action of the actuating device compliments or supplements the manually applied force to position the blade in the fully retracted position within recess 57 of the handle. Depending upon the strengths of the magnetic fields produced by magnets 65*c* and 66*c*, the handle and the blade may consist of magnetizable or non magnetizable materials.

In the embodiments shown and described and the various modifications thereof as indicated, the mechanism employed functions to bias an angular displacement of the implement relative to the handle through the use of repellant and/or attractive magnetic forces. Such forces are employed either to biasingly retain the implement in a selected position or biasingly angularly displace the implement. In doing so, such magnetic forces either oppose or compliment or assist the manual force applied. When the implement is in its retracted position and it is desired to pivot it to its extended position, a manual force is first applied to overcome the magnetic force biasing it in the retracted position. Once such magnetic retaining force has been overcome, the magnetic force compliments or supplements the manual force in pivoting the implement to the extended positive. Conversely, when the implement is in its extended position and it is desired to pivot it to its retracted position, a manual force is first applied to overcome the magnetic force biasing it in the extended position. Once such magnetic retaining force is overcome, the magnetic force compliments or supplements the manual force in pivoting the implement to the retracted position. In providing for the aforementioned angular displacements of the two components and modifications of such displacements, a number of variables including the number of magnetic elements, the polarities of the fields of such elements and the positioning of such elements relative to each other may be combined in various arrangements to produce any desired angular displacement of one of such components relative to the other.

Although the several embodiments of the invention described provide for a knife having a handle and a pivotally connected blade, it should be understood that any form of implement may be used pivotally connected to a handle, including a flat blade screwdriver, a Phillips head screwdriver, a bottle opener, a file, a key, a pick, a cork screw, a fork, a spoon and the like.

In any of the embodiments as described, it will be appreciated that the inventive tool is not only simple in design, comparatively easy to manufacture and relatively inexpensive to produce but highly effective in performance.

From the foregoing detailed description, it will be evident that there are a number of changes, adaptations, and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. A tool comprising:

a handle;

an implement pivotally connected to said handle;

a first magnetic element mounted on said implement having a magnetic field of a selected polarity intersecting a path disposed circumferentially relative to the axis of said pivotal connection; and a second magnetic element mounted on said handle having a magnetic field of a polarity of one of the same or the opposite of said selected polarity intersecting said circumferential path whereby dependant upon the angular relationship of said handle and implement said magnetic fields will have the effect of one of a first interaction, producing no motive force for angularly biasing said implement relative to said handle, a second interaction, producing a repellant motive force for angularly biasing said implement relative to said handle and a third interaction, producing an attractive motive force for angularly biasing said implement relative to said handle.

2. A tool according to claim 1 wherein said magnetic elements are disposable relative to each other to provide opposed magnetic fields.

3. A tool according to claim 1 wherein said magnetic elements are disposable relative to each other to provide attracting magnetic fields.

4. A tool according to claim 1 wherein said handle and implement are provided with means engageable to arrest said angular displacement thereof.

5. A tool according to claim 1 wherein said magnetic elements are disposable relative to each other to produce a force biasing said handle and implement toward a retracted relationship.

6. A tool according to claim 5 wherein said handle and implement include means engageable to arrest said angular displacement.

7. A tool according to claim 6 wherein said magnetic elements are disposable relative to each other when said handle and implement are in said retracted relationship, providing a force for retaining said arresting means engageable.

8. A tool according to claim 7 wherein said magnetic elements are disposable relative to each other in partially overlapping relation when said handle and implement are disposed in said retracted relation and said arresting means is engaged.

9. A tool according to claim 1 wherein said magnetic elements are disposable relative to each other to produce a force biasing said handle and implement toward an extended relationship.

10. A tool according to claim 9 wherein said handle and implement include engageable means for arresting said angular displacement.

11. A tool according to claim 10 wherein said magnetic elements are disposable relative to each other when said handle and implement are in said extended relationship, providing a biasing force for retaining said arresting means engageable.

12. A tool according to claim 11 wherein said magnetic elements are disposable relative to each other in partially overlapping engagement when said handle and implement are disposed in said extended relationship, providing a biasing force for retaining said arresting means engageable.

13. A tool according to claim 12 wherein said magnetic elements are angularly displaceable an angle in the range of 1° to 50° relative to the axis of said pivotal connection when said handle and implement are in said extended relationship.

14. A tool according to claim 5 wherein said handle includes a recess into which said implement is at least partially received when said handle and implement are biased toward said retracted relationship.

15. A tool according to claim 1 wherein said implement comprises a blade.

16. A tool according to claim 1 wherein said implement comprises a blade and said handle includes a recess into which said blade is at least partially received when said handle and implement are biased toward said retracted relationship.

17. A tool according to claim 1 wherein said handle comprises an elongated member which may be manually gripped.

18. A tool according to claim 1 wherein said handle comprises an elongated member which may be manually gripped, having a recess into which said implement is at least partially received when said handle and implement are biased toward said retracted relationship, and said implement comprises a blade.

19. A tool according to claim 1 wherein said magnetic elements are formed of NbFeB.

20. A tool according to claim 1 wherein said handle is formed of a non-magnetic material.

21. A tool according to claim 20 wherein said handle is formed of a material selected from the group consisting of a plastic, a ceramic and aluminum.

22. A tool according to claim 1 wherein said implement is formed of a non-magnetic material.

23. A tool according to claim 1 wherein said implement is formed of a stainless steel material.

24. A tool comprising:

a handle;

an implement pivotally connected to said handle for angular displacement between retracted and extended positions relative to said handle;

first and second magnetic elements disposed on said implement, angularly spaced apart, each having a magnetic field of a selected polarity intersecting a path disposed circumferentially, relative to the axis of said pivotal connection; and third and fourth magnetic elements disposed on said handle, angularly spaced apart, each having a magnetic field of a selected polarity intersecting said circumferential path whereby dependant upon the polarities of said magnetic fields and the angular relationships thereof, said magnetic fields shall have the effect of one of a first interaction, producing no motive force acting to bias an angular displacement of said implement relative to said handle, a second interaction producing a repellant motive force acting to bias an angular displacement of said implement relative to said handle, and a third interaction producing an attractive force acting to bias an angular displacement of said implement relative to said handle.

25. A tool according to claim 24 wherein said first and second magnetic fields are of opposite polarities and said third and fourth magnetic fields are of opposite polarities.

26. A tool according to claim 24 wherein one of said first and second magnetic elements is positioned on said implement and one of said third and fourth magnetic elements is positioned on said handle whereby when said implement is disposed in a fully retracted position relative to said handle, the fields of said ones will interact to produce a motive force acting to bias said implement toward said fully retracted position.

27. A tool according to claim 26 wherein said ones of said interacting fields are of the same polarity.

28. A tool according to claim 27 wherein said interacting fields partially overlap.

29. A tool according to claim 28 wherein said interacting fields overlap in the range of 1° to 5°.

30. A tool according to claim 26 wherein said ones of said interacting fields are of opposed polarities.

31. A tool according to claim 30 wherein said interacting fields partially overlap.

32. A tool according to claim 31 wherein said interacting fields overlap in the range of 1° to 5°.

33. A tool according to claim 24 wherein one of said first and second magnetic elements is positioned on said implement and one of said third and fourth magnetic elements is positioned on said handle whereby when said implement is in a fully extended position relative to said handle, the fields of said ones will interact to produce a motive force acting to bias said implement toward said fully extended position.

34. A tool according to claim 33 wherein said ones of said interacting fields are of the same polarity.

35. A tool according to claim 34 wherein said ones of said interacting fields partially overlap.

36. A tool according to claim 35 wherein said interacting fields overlap in the range of 1° to 5°.

37. A tool according to claim 33 wherein said ones of said interacting fields are of opposed polarities.

38. A tool according to claim 37 wherein said interacting fields partially overlap.

39. A tool according to claim 38 wherein said interacting fields overlap in the range of 1° to 5°.

40. A tool according to claim 24 wherein one of said first and second magnetic elements is positioned on said implement and one of said third and fourth magnetic elements is positioned on said handle whereby when said implement is disposed between said fully retracted and fully extended positions relative to said handle, the fields of said ones will interact to produce a motive force acting to bias an angular displacement of said implement relative to said handle.

41. A tool according to claim 40 wherein said ones of said interacting fields are of the same polarity.

42. A tool according to claim 40 wherein said ones of said interacting fields are of opposite polarities.

43. A tool according to claim 24 wherein said magnetic fields are of the same polarity.

44. A tool according to claim 24 wherein said first and second magnetic fields are of the same polarity and said third and fourth magnetic fields are of opposed polarities.

45. A tool according to claim 24 wherein said first and second magnetic fields are of opposed polarities and said third and fourth magnetic fields are of the same polarity.

46. A tool according to claim 24 wherein said first and second magnetic fields are of the same polarity and said third and fourth magnetic fields are of the same polarity which is opposed to the polarity of said first and second magnetic fields.

47. A tool according to claim 24 wherein said handle includes a recess into which said implement is at least partially received when said implement is disposed in said retracted position relative to said handle.

48. A tool according to claim 24 wherein said implement comprises a blade.

49. A tool according to claim 48 wherein said handle includes a recess into which said blade is at lest partially received when said blade is in said retracted position relative to said handle.

50. A tool according to claim 24 wherein said magnetic elements are formed of NbFeB.

51. A tool according to claim 24 wherein said handle is formed of a non-magnetic material.

52. A tool according to claim 1 wherein said implement is formed of a non-magnetic material.

53. A tool comprising:

a handle;

an implement pivotally connected to said handle for angular displacement between retracted and extended positions relative to said handle;

one of said handle and said implement having a magnetic element; and the other of said handle and said implement having at least a portion of a magnetically attractable material disposable within the magnetic field of said magnetic element whereby when said portion is positioned within said magnetic field said implement will be caused to bias angularly relative to said handle.

54. A tool according to claim 53 wherein said magnetic element is positioned on said one of said handle and implement and said attractable portion is positioned on said other of said handle and implement whereby upon a certain angular relationship therebetween, said implement will be biased into said retracted position relative to said handle.

55. A tool according to claim 53 wherein said magnetic element is positioned on said one of said handle and implement and said attractable portion is positioned on said other of said handle and implement whereby upon a certain angular relationship therebetween, said implement will be biased into said extended position relative to said handle.

56. A tool according to claim 53 wherein said magnetic element is positioned on said one of said handle and implement and said attractable portion is positioned on said other of said handle and implement whereby upon a certain angular relationship therebetween, said implement will be biased angularly between said retracted and extended positions.

57. A tool according to claim 53 wherein said handle is provided with a recess into which said implement is received when in said retracted position.

58. A tool according to claim 57 wherein said implement comprises a blade.

59. A tool according to claim 53 wherein said magnetic element is disposed in said handle.

60. A tool comprising:

a handle;

an implement pivotally connected to said handle for angular displacement about a first axis relative to said handle;

first and second telescopically connected actuating members, one of which is pivotally connected to said handle for angular displacement about a second axis relative to said handle, and the other of which is pivotally connected to said implement for angular displacement relative to said implement about a third axis radially displaced relative to said first axis; and said actuating members having magnetic elements providing opposed fields of the same polarity whereby when said third axis is disposed on a first side of a line intersecting said first and second axes, said implement will be caused to be biased angularly in a first direction relative to said handle, and when said third axis is disposed on the other side of said intersecting line, said implement shall be caused to be biased in a direction opposite of said first direction.

61. A tool according to claim 60 wherein said handle is provided with a recess into which said implement is received when biased in said first direction.

62. A tool according to claim 60 wherein said implement comprises a blade.

63. A tool according to claim 62 wherein said handle is provided with a recess into which said implement is received when biased in said first direction.

64. A tool according to claim 60 wherein one of said actuating members comprises a tubular member closed at one end, the other of said actuating members comprises a rod received within said tubular member, and said magnetic elements are disposed within said tube.

* * * * *

UNITED STATES PATENT AND TRADEMARK OFFICE

CERTIFICATE OF CORRECTION

PATENT NO. : 7,111,402 B1
APPLICATION NO. : 11/075722
DATED : September 26, 2006
INVENTOR(S) : Robert E. Pearman It is certified that error appears in the above-identified patent and that said Letters Patent is hereby corrected as shown below:

Col. 8 at line 43, the recitation "50°" should be corrected to read --5°--.

Col. 10 at line 41, the spelling of "lest" should be corrected to read --least--.

Signed and Sealed this

Twentieth Day of November, 2007

JON W. DUDAS
*Director of the United States Patent and Trademark Office*